US005271570A

United States Patent [19]

Satake et al.

[11] Patent Number: 5,271,570

[45] Date of Patent: Dec. 21, 1993

[54] METHOD OF AND SYSTEM FOR FLOUR MILLING

[75] Inventors: Toshihiko Satake; Satoru Satake, both of Higashihiroshima; Takeshi Ishii; Yoshihiro Tokui, both of Tokyo, all of Japan

[73] Assignee: Satake Corporation, Tokyo, Japan

[21] Appl. No.: 926,398

[22] Filed: Aug. 10, 1992

[30] Foreign Application Priority Data

Aug. 29, 1991 [JP] Japan ..... 3-246788

[51] Int. Cl.[5] ..... B02C 9/04

[52] U.S. Cl. ..... 241/7; 241/8; 241/42

[58] Field of Search ..... 241/7, 8, 9, 81, 42, 241/43; 426/482, 483, 507

[56] References Cited

U.S. PATENT DOCUMENTS

| | | | |
|---|---|---|---|
| 2,379,677 | 7/1945 | Borsakovsky | 426/483 |
| 4,986,997 | 1/1991 | Posner et al. | 426/622 |
| 5,002,788 | 3/1991 | Satake | 426/507 |
| 5,104,671 | 4/1992 | Wellman | 426/483 |
| 5,115,984 | 5/1992 | Satake | 241/7 |
| 5,145,117 | 9/1992 | Satake et al. | 241/8 |

FOREIGN PATENT DOCUMENTS

| | | | |
|---|---|---|---|
| 2067956 | 8/1971 | France | 241/7 |
| 1123720 | 11/1984 | U.S.S.R. | 241/7 |

*Primary Examiner*—Mark Rosenbaum
*Assistant Examiner*—John M. Husar
*Attorney, Agent, or Firm*—Fish & Richardson

[57] ABSTRACT

A flour milling method and system therefor comprising the steps of separating foreign materials from raw wheat, humidifying the raw wheat, polishing the raw wheat, and conditioning the polished wheat, further comprises a step of cleaning the polished wheat at a subsequent step of the polishing the raw wheat. The flour milling method and system therefor may further comprises a step of stirring the cleaned polished wheat at a subsequent step of the cleaning step of the polished wheat. The bran powder which has been entered into the creases of the polished wheat at the polishing step, absorbs cleaning water and then flows out from the creases with the cleaning water. Since the bran powders in the creases of the polished wheat can be removed effectively, the milling efficiency is improved.

10 Claims, 4 Drawing Sheets

METHOD OF AND SYSTEM FOR FLOUR MILLING

BACKGROUND OF THE INVENTION

1. Field of the Invention

The present invention relates to milling of wheat or the like and, more particularly, to a flour milling method and a system therefor in which the wheat polishing is carried out as a preparatory step.

2. Description of the Prior Art

Milling is a process wherein wheat or the like is ground and pulverized to collect endosperm portions in a powder condition such that bran portions containing much ash contents (unwanted components) are not mixed with the endosperm portions while the endosperm portions (weight conversion percentage: approximately 84%), the bran portions (the same: 13.5%) having a plurality of layers, such as a pericarp layer, a testa layer and a layer of exosperm, on the outside of the endosperm portions, and embryos (the same: 2.5%) are separated from each other. However, it is extremely difficult to completely separate the endosperm portions and the bran portions from each other. A collecting rate (yield) of products relatively low in mixing of the bran portions is normally in the order of 75%.

Whereas the milling method (milling of raw wheat) as described above in which wheat kernels as raw material (hereinafter referred to as "raw wheat") are directly ground and pulverized, a milling method (milling of polished wheat) in which bran portions of the raw wheat are peeled off or separated to expose endosperm portions and, subsequently, the wheat is ground and pulverized is well known from, for example, Japanese Patent Application Kokai No. Sho 62(1987)-87250 filed by the same applicant.

Polishing prior to the milling of wheat contributes to the reduction in the necessary number of roll machines or the like and also contributes to the improvement in a milling efficiency. However, this method has the following problems: Specifically, the wheat polishing is usually executed such that a grinding polishing roll made of emery is mounted within a bran-removing polishing cylinder having a perforated wall to define a polishing chamber, and bran portions of the wheat kernels other than longitudinal grooves (creases) thereof are shaved off in the polishing chamber. However, there is a disadvantage that the separated bran portions enter into the longitudinal creases so that a milling characteristic is deteriorated.

SUMMARY OF THE INVENTION

In view of the above-discussed problems, the present invention aims at providing a milling method and system therefor wherein, after the wheat is polished, bran powder which has entered into the longitudinal creases can easily be removed.

According to one aspect of the invention, there is provided a flour milling method comprising the steps of separating foreign materials from raw wheat, humidifying the raw wheat to soften outer portions of the raw wheat, polishing the raw wheat, and conditioning the polished wheat, the method further comprising a step of cleaning the polished wheat at a subsequent step of the polishing step of the raw wheat.

According to another aspect of the invention, there is provided a system for flour milling comprising:

a separating means for separating foreign materials from raw wheat;

a humidifying means arranged downstream of the separating means, for humidifying the raw wheat to soften outer portions of the raw wheat;

a polishing means arranged downstream of the humidifying means, for polishing the humidified raw wheat to produce wheat kernels;

a cleaning means arranged downstream of the polishing means, for cleaning the polished wheat kernels; and a conditioning means arranged downstream of the cleaning means, for conditioning the cleaned wheat kernels.

Further, it is effective if a stirring step is provided at a subsequent step of the wheat cleaning step.

Moreover, the wheat cleaning step is performed by a wheat cleaning apparatus in which an inner cylinder communicating with a kernel feeding path and a kernel discharge path is rotatably arranged and extending laterally within a machine frame which is provided at one end with the kernel feeding path and at the other end with the kernel discharge path, wherein a portion of the inner cylinder adjacent to a terminal end thereof is formed into a draining portion of a perforated wall, wherein a water pipe for supplying cleaning water into the kernel feeding path is provided, wherein a screw rotated in normal or reverse direction is arranged within the inner cylinder, and wherein the inner cylinder and the screw are so formed as to be rotated in the same direction and at speeds different from each other so as to deliver the wheat kernels towards the kernel discharge path.

Water is added to the raw wheat after the foreign material separating operation has been done. The raw wheat is polished whereby the bran portion except at the longitudinal creases are removed. However, the separated bran powders enter into the longitudinal creases. The bran powders are removed by cleaning with water, and the water addition is applied to the wheat. After the wheat has been subjected to the tempering or conditioning, the wheat is milled to obtain finished flour.

The polished wheat kernels immediately after cleaning are apt to be adhered to each other under an action of gluten. Accordingly, the polished wheat is stirred for a predetermined period of time by the stirring step.

According to a wheat cleaning apparatus as one preferred embodiment of the invention, the polished wheat supplied to the kernel feeding path together with the cleaning water flows into the rotating inner cylinder and is spread against the inner surface of the inner cylinder by the centrifugal force. At this time, the screw is rotated in either the normal direction (transporting direction) or the reverse direction (a direction opposite to the transporting direction). Specifically, in the case where the screw is rotated in the normal direction, the screw and the inner cylinder are rotated in the same direction, but the screw is rotated faster than the inner cylinder. In this case, the wheat kernels are transported towards the kernel discharge path by the screw which is rotated faster than the inner cylinder. Contrary to this, in the case where the screw is rotated in the reverse direction, the screw and the inner cylinder are rotated in the same direction, but the inner cylinder is rotated faster than the screw. In this case, the wheat kernels are guided by the screw blade, and are transported towards the kernel discharge path by the inner cylinder which is rotated faster than the screw. In this manner, where the screw is rotated in either the normal or reverse direction, during the period in which the wheat kernels are transported towards the kernel discharge path, the bran powders within the longitudinal creases absorb water and, thus, they are brought to a condition in which they are apt to flow out from the creases by the stirring action. When the wheat kernels are centrifugally dehydrated at the draining portion which is provided at the terminal end portion of the inner cylinder, the bran powders are forcibly exhausted to a location outside the inner cylinder together with the water.

BRIEF DESCRIPTION OF THE DRAWINGS

The above and other objects, features and advantages of the present invention will be apparent from the following description of preferred embodiments of the invention explained with reference to the accompanying drawings, in which.

DESCRIPTION OF THE PREFERRED EMBODIMENTS

Figure 1:
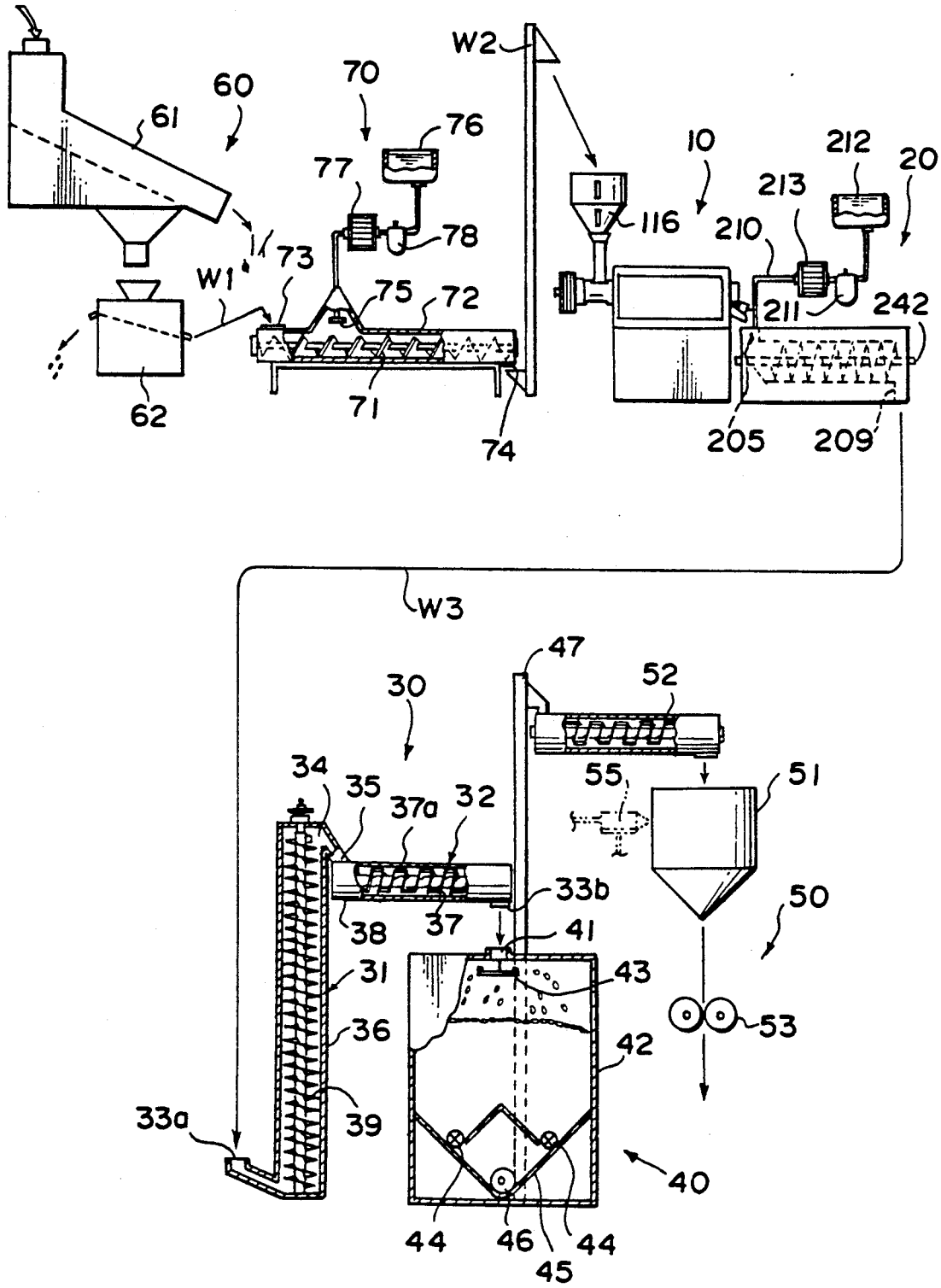
FIG. 1 is a schematic front elevational view showing a flour milling system of an embodiment according to the invention.

A preferred embodiment of the invention will be described with reference to the accompanying drawings. A wheat polishing apparatus 10, a wheat cleaning apparatus 20, a stirring apparatus 30 and a tempering tank 42 serving as a conditioning or tempering apparatus 40 are provided, in these sequence, for carrying out preparatory steps of a milling apparatus 50 (refer to FIG. 1). Further, a separating apparatus 60 and a humidifying apparatus 70 are arranged for sequential preparatory steps of the wheat polishing apparatus 10.

First, the separating apparatus 60 will be described. The separating apparatus 60 is formed by, for example, a rough sorting machine 61 and a stone removing machine 62. The rough sorting machine 61 removes relatively light impurities such as straw waste, plant pieces, string waste, dust or the like which are unavoidably present in the raw wheat taken out from a silo (not shown) and the like which stores the raw wheat. On the other hand, the stone removing machine 62 removes such as metal pieces and small stones. The separating apparatus 60 is arranged as a means for carrying out a very first step of milling steps.

At a location downstream of the above separating apparatus 60, the humidifying apparatus (also called dampener) 70 is arranged through a transporting path W1. The humidifying apparatus 70 is provided with a conveyor screw 71 which is arranged within a cylinder trough 72 having at one end a supply port 73 and at the other end a discharge port 74. A shower nozzle 75 extends to an upper portion of the cylinder trough 72. The shower nozzle 75 is connected to a water tank 76 through a heater 77 and an electromagnetic or solenoid valve 78. The humidifying apparatus 70 is provided for the purpose of executing water addition to the raw wheat for the wheat polishing at a subsequent step. An amount of moisture addition is set by the solenoid valve 78 so as to add moisture mainly to the surfaces of the wheat.

Figure 2:
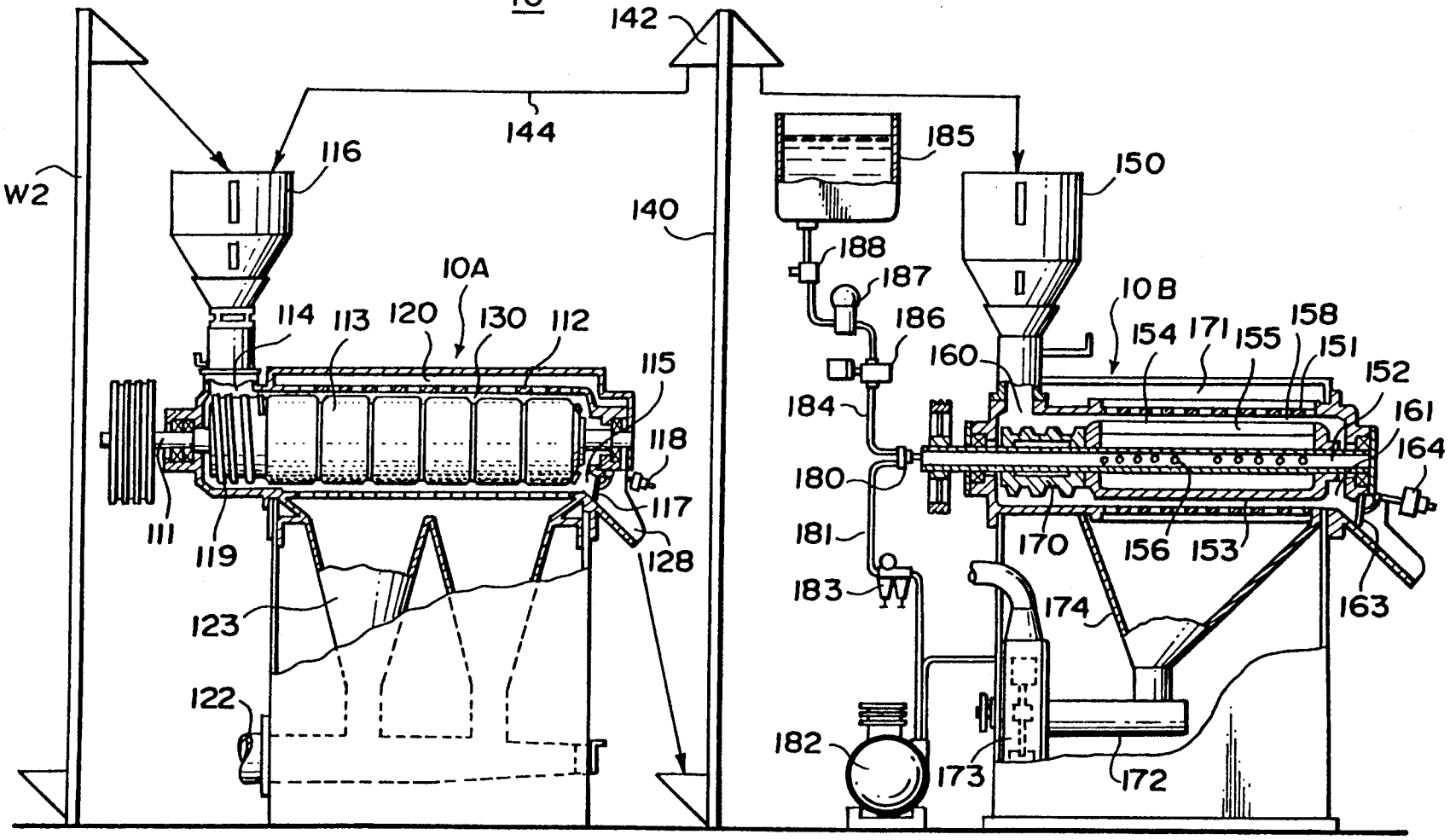
FIG. 2 is a partially broken-away, enlarged front elevational view showing an embodiment of a wheat polishing apparatus illustrated in FIG. 1.

Next, with reference to FIG. 2, the wheat polishing apparatus 10 at a subsequent step of the humidifying apparatus 70 will be described in detail. The wheat polishing apparatus 10 in the present embodiment is formed by a grinding-type wheat polishing machine 10A and a friction-type wheat polishing machine 10B. The grinding-type wheat polishing machine 10A is provided with a main spindle 111 which extends through a bran-removing polishing cylinder 112 which has a perforated wall. Grinding polishing rolls (milling rolls) 113 made of emery are mounted on the main spindle 111. A gap or clearance between the grinding polishing rolls 113 and the bran-removing polishing cylinder 112 defines a polishing chamber 130. The polishing chamber 130 has one end portion which communicates with a supply port 114, and the other end portion which communicates with a discharge port 115. A supply hopper 116 is arranged above the supply port 114. A pressure plate 117 biased by a weight 118 is arranged at the discharge port 115. Moreover, a kernel feeding roll (feed roll) 119 having a helical blade on a circumferential surface is rotatably mounted on the main spindle 111 at a location corresponding to the supply port 114. Furthermore, a bran collecting chamber 120 is defined around the bran-removing polishing cylinder 112. A lower portion of the bran collecting chamber 120 communicates with a bran collecting duct 122 through a bran collecting hopper 123. The bran collecting duct 122 is connected to a bag filter and a fan which are not shown in the drawings.

A discharge chute 128 provided at the discharge port 115 of the grinding-type wheat polishing machine 10A communicates with a supply hopper 150 of the friction-type wheat polishing machine 10B through a kernel elevating apparatus 140. A selector valve 142 may be provided at a delivery portion of the kernel elevating apparatus 140 to form a recirculation feedback path 144 extending to the supply hopper 116 of the grinding-type wheat polishing machine 10A. The friction-type wheat polishing machine 10B has a perforated bran-removing polishing cylinder 151 formed into a cylindrical or a polygonal configuration such as a hexagonal cylinder, and a hollow main spindle 152 extending horizontally through the bran-removing polishing cylinder 151. Mounted on the hollow main spindle 152 having one end opened is a friction polishing roll 153 which is provided with stirring projections 154, and jetting grooves (slits) 155 provided along the stirring projections 154. The friction polishing roll 153 is hollow, and a plurality of vent bores 156 are provided in a peripheral surface of the hollow main spindle 152 which is arranged within the friction polishing roll 153. Moreover, a gap or clearance between the friction polishing roll 153 and the bran-removing polishing cylinder 151 defines a polishing chamber 158. The polishing chamber 158 has one end portion communicated with a supply port 160, and the other end portion communicated with a discharge port 161. The supply hopper 150 is arranged above the supply port 160, and a pressure plate 163 biased by a weight 164 is arranged at the discharge port 161. Further, a kernel feeding roll 170 having a helical blade on a circumferential surface thereof is fixedly mounted on the hollow shaft 152 at a location substantially corresponding to the supply port 160, so that it rotates together with the hollow shaft 152. A bran collecting chamber 171 is formed around the bran-removing polishing cylinder 151, and it has a lower portion which communicates with a bran collecting duct 172 and a bran collecting fan 173 through a bran collecting hopper 174.

A moisture adding apparatus in the friction-type wheat polishing machine 10B will next be described. The open end of the hollow main spindle 152 is connected to a nozzle opening of a binary or two-fluid nozzle 180. An air pipe 181 having one end connected to the two-fluid nozzle 180 is connected to an air compressor 182 through an air filter 183. Similarly, a water supplying pipe 184 having one end connected to the two-fluid nozzle 180 is connected to a water tank 185 through a solenoid valve 186, a flow meter 187 and a flow control valve 188.

Figure 3:
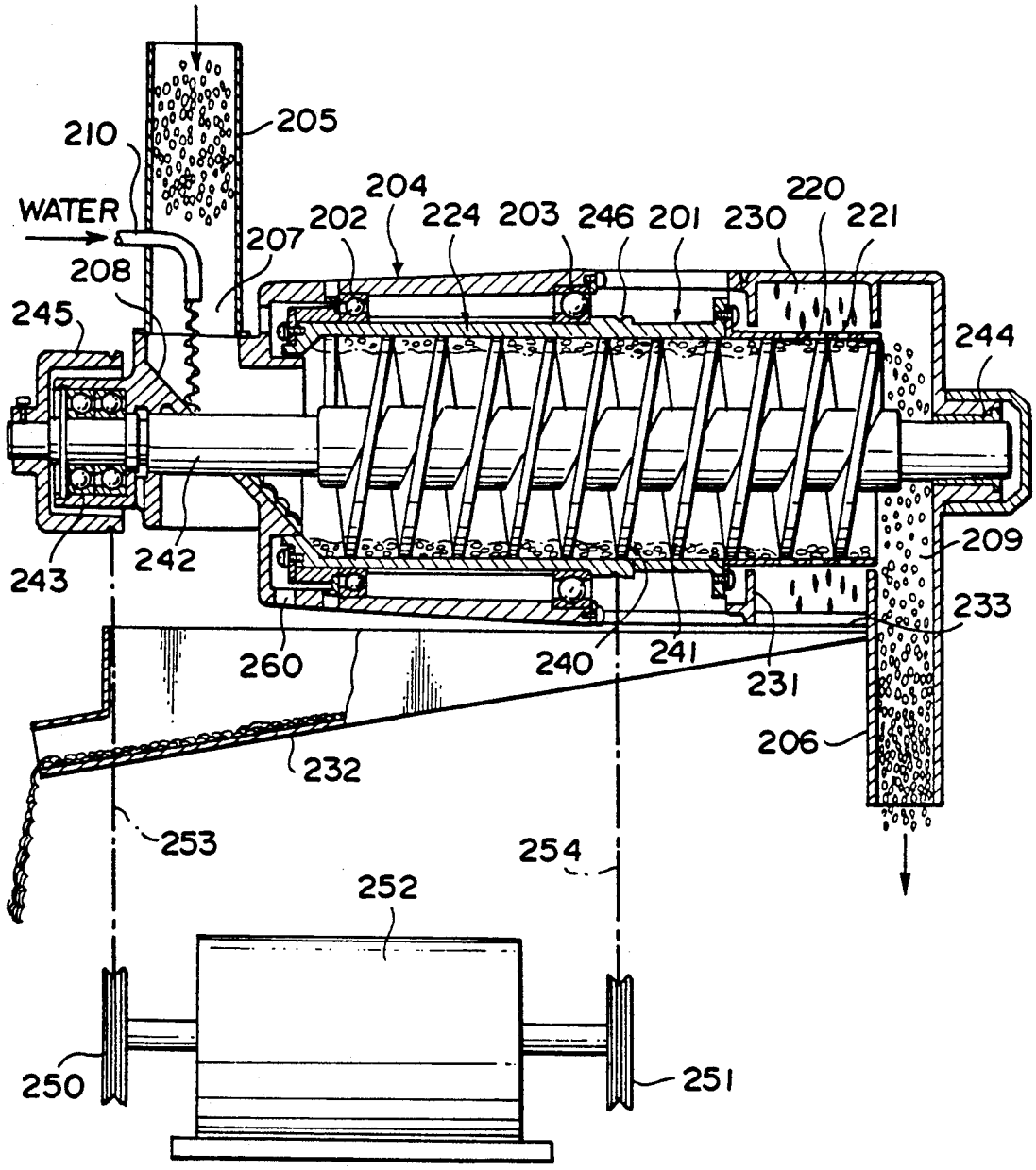
FIG. 3 is an enlarged cross-sectional view showing an embodiment of a wheat cleaning apparatus illustrated in FIG. 1.

Next, referring to FIG. 3, the wheat cleaning apparatus 20 arranged at a subsequent step of the wheat polishing apparatus 10 will be explained. An inner cylinder 201 is rotatably and horizontally mounted by means of pairs of bearings 202 and 203, within a cylindrical machine frame 204 which is provided at one end with a supply chute 205 and at the other end with a discharge chute 206. The inner cylinder 201 has one end whose opening communicates with a kernel supply passage 207 formed by the supply chute 205 and an inclined supply chute 208 connected to the supply chute 205. An opening of the inner cylinder 201 at the other end thereof communicates with a kernel discharge passage 209 which is formed by the discharge chute 206. A water tube 210 provided with a solenoid valve 211 (see FIG. 1) serving as a flow control means has one end thereof which extends into the kernel feeding passage 207. As seen in FIG. 1, the other end of the water pipe 210 is connected to a water tank 212, and a heater 213 is interposed at the water pipe 210. Furthermore, the inner cylinder 201 has at its one terminal end a perforated wall 220 which constitutes a draining section 221. An interior of the inner cylinder 201 except for the above constitutes a dipping or immersion section 224. The draining section 221 has a periphery or circumference thereof which defines a water discharge chamber 230 by a partition wall 231. A water discharge chute 232 is arranged at a location below the water discharge port 233 opened at a lower bottom end of the water discharge chamber 230.

Moreover, a screw 240 having a screw blade 241 thereon and formed by resin or the like is mounted horizontally extending through the entire length of the inner cylinder 201. Specifically, a screw shaft 242 is rotatably supported by a bearing 243 and a bush 244 at both the ends of the machine frame 204. The screw shaft 242 has an end thereof adjacent to the kernel supply passage 207, on which a driven pulley 245 is mounted. On the other hand, a driven pulley 246 is formed on an outer periphery wall of the inner cylinder 201. These driven pulleys 245 and 246 are interlocked with and connected to a pair of motor pulleys 250 and 251, which are mounted respectively on both the ends of a motor 252 and which are the same with each other in diameter, through V-belts 253 and 254. The driven pulleys 245 and 246 are arranged such that the driven pulley 245 of the screw 240 is formed smaller in diameter than the driven pulley 246 of the inner cylinder 201, so that the screw 240 is rotated faster than the inner cylinder 201. Further, a gap between the screw blade 241 and the inner cylinder 201 is determined depending on the diameters of the wheat kernels and is generally set to approximately 0.3 mm. It is needless to say that the perforated wall 220 of the draining section 221 is formed such that the wheat kernels do not pass therethrough. Further, it is preferable that a water drainage bore 260 is formed in the bottom part of the machine frame 204.

Though a construction in which the inner cylinder 201 is rotated faster than the screw 240 is not illustrated, it is needless to say that such construction can be readily realized by known methods and techniques, for example, by the necessary modification of the diameters of pulleys concerned.

Now, referring back to FIG. 1, the stirring apparatus 30 will be described. The stirring apparatus 30 is formed by an upwardly-feeding screw conveyor 31 and a laterally-feeding screw conveyor 32. The upwardly-feeding screw conveyor 31 has at its lower portion a supply port 33*a* connected, through a transporting path W3, to the kernel discharge passage 209 of the wheat cleaning apparatus 20 described above. Further, a discharge port 34 provided at an upper portion of the upwardly-feeding screw conveyor 31 is connected to a supply port 35 of the laterally-feeding screw conveyor 32. The upwardly-feeding screw 31 is arranged within an upstanding trough 36, while the laterally-feeding screw conveyor 32 is arranged such that a screw 37 is rotatably arranged within a trough 38 arranged horizontally. The screw 37 of the laterally-feeding screw conveyor 32 may be provided with a plurality of stirring bars 37*a*.

The laterally-feeding screw conveyor 32 has a discharge port 33*b* connected to a supply port 41 of the tempering tank 42 serving as the conditioning apparatus 40. A rotating scattering blade 43 is vertically provided at the supply port 41. A pair of rotary valves 44 are provided horizontally at the bottom of the tank 42. Moreover, a receiving chute 45 is provided below the rotary valves 44. A discharge screw conveyor 46 is arranged within the receiving chute 45. A transporting terminal portion of the discharging screw conveyor 46 is connected to a supply portion of a bucket elevator 47.

The bucket elevator 47 has a discharge port which communicates with a regulating tank 51 of the milling apparatus 50 through a laterally-feeding screw conveyor 52. A first milling machine 53 is arranged below the regulating tank 51. Thereafter, a plurality of roll machines, sifters, purifiers and so on (all not shown in the drawings) are appropriately arranged, so that they repeatedly and alternately mill and sift the kernels to provide a finished wheat flour of high quality. In this connection, it may be arranged so that the regulating tank 51 is provided with a moisture adding nozzle 55.

Now, a detail explanation of the operation of the above-described embodiment will be made.

First, large foreign materials and impurities are removed from the raw wheat taken out from a tank or the like, by the rough sorting machine 61. Small stones, metal pieces and the like are then removed from the raw wheat by the stone removing machine 62. Thus, the raw wheat is cleaned. The raw wheat, which has been subjected to the separating action and from which the foreign materials have been removed, is first supplied to the humidifying apparatus 70, and is subjected to the water addition by means of the shower nozzle 75 arranged therein. An amount of moisture addition may be such that the water penetrates into only the wheat-kernel bran portions, and is adjusted by the solenoid valve 78 or the like so as to be 1~2% with respect to the wheat weight. Further, in the case where a water temperature is low such as in a winter season, if the water temperature is raised by the heater 77, the penetration of the moisture is facilitated. In the course of the raw wheat subjected to the water addition being stirred and transported by the screw 71, the moisture is gradually penetrated into the bran portions of the raw wheat. The raw wheat is then transported by the kernel elevation machine, and is delivered to the wheat polishing apparatus 10.

In the wheat polishing apparatus 10, the wheat is first poured into the supply hopper 116 of the grinding-type wheat polishing machine 10A, is transported to the polishing chamber 130 by the kernel feeding roll 119 and is subjected to a polishing action of the grinding polishing roll 112. Specifically, the bran portions of the wheat kernels excepting at the longitudinal creases thereof are peeled off by the emery on the circumferential surfaces of the grinding polishing rolls 113 which are rotated at a relatively high peripheral speed (equal to or higher than 600 mm/min, for example), while being finely pulverized. Since the bran portions of the wheat kernels have been humidified and softened by the moisture addition of the humidifying apparatus 70, a grinding action is effectively applied to the bran portions. The wheat kernels discharged from the polishing chamber 130 against the pressure applied by the pressure plate 117 are transported to the kernel elevating machine 140, are then poured into the supply hopper 150 of the friction-type wheat polishing machine 10B, and are further fed into the polishing chamber 158 by the kernel feeding roll 170. At this time, if the wheat kernels discharged from the polishing chamber 130 have not been milled sufficiently, they are fed-back to the grinding-type wheat polishing machine 10A through the selector valve 142 and the recirculation feedback path 144 and then they are milled thereat once again. The polishing chamber 158 of the friction-type wheat polishing machine 10B is kept under a comparatively high pressure (average pressure is 200 g/cm$^2$ or higher, for example). Friction between the wheat kernels occurs by the stirring projections 154 of the friction-type polishing roll 153 which is rotating at a peripheral speed equal to or less than about one half of the peripheral speed of the grinding polishing roll 130 in the grinding-type wheat polishing machine 10A. At this time, a mist jetted into the hollow main spindle 152 from the nozzle opening of the two-fluid nozzle 180 flows into the hollow portion within the friction polishing roll 153 through the vent bores 156 provided in the peripheral surface of the hollow main spindle 152, flows off into the polishing chamber 158 from the jetting grooves 155, and is added to the wheat kernels. By so doing, the surfaces of the wheat kernels are again humidified so that a frictional force increases. The bran portions remaining on and adhered to the surfaces of the kernels are swept away, and a grinding action effectively develops between the kernels. The removed bran powders leak out from the bran removing polishing cylinder 151 by an air jetted from the jetting grooves 155, and are transported to a bag filter or the like by the bran collecting fan 173.

The wheat kernels (polished kernels) discharged from the discharge port 161 of the friction-type wheat polishing machine 10B are next forwarded to the supply chute 205 of the wheat cleaning apparatus 20. Start-up of the motor 252 causes the screw 240 and the inner cylinder 201 to start to be rotated in the same direction simultaneously. It is assumed here that the rotational speed of the inner cylinder 201 is 1600 rpm, and that of the screw 240 is 1720 rpm. Then, the polished wheat kernels from the hopper or the like (not shown in the drawings) flow down along the supply chute 205, and water is supplied from the water pipe 210. An amount of water to be supplied is 50~100% of the amount of the polished wheat kernels supplied. In this embodiment, the flow rate of the polished wheat is 200 kilograms per hour, and the water is supplied 200 litters per hour.

When the system starts its operation under the conditions described above, the polished wheat kernels flowing down along the supply chute 205 are in contact with the water during the period in which the polished wheat kernels flow down along the supply chute 208, and flow into the immersion section 224 within the inner cylinder 201 as they are. Since the inner cylinder 201 is rotating at 1600 rpm, the polished wheat is spread on the inner peripheral wall of the inner cylinder 201 by a centrifugal force. Then, a transverse cross-sectional surface is in a state of substantially an annular configuration. On the other hand, since the screw 240 is rotating at 1720 rpm, the screw 240 transports the polished wheat kernels and the water to the discharge port 209 with 120 rpm (=1720−1600 rpm). For this reason, the polished wheat kernels immersed within the water pass through the immersion section 224 for about 4~5 seconds while being gently stirred. During this period, water enters into the surfaces of the polished wheat kernels, and the bran powder having entered the longitudinal creases in the polished wheat kernels absorbs the water so that a condition becomes such that the bran powder is apt to flow out from the creases. Accordingly, the time required for the bran powder to pass the immersion section 224 is only the time in which the bran powder absorbs the water. The time in which the wheat kernels pass through the immersion section 224 can be appropriately set by the change of the rotational speed of the screw 240.

The wheat having been polished and the water having been used for cleaning, which have passed through the immersion section 224, then pass through the draining section 221 and, during this period of 1~2 seconds in which they pass, the water is blown off from the perforated wall 220 by the centrifugal force. Together with the blown off water, the bran powder which has absorbed the water in the longitudinal creases of the wheat kernels and which is apt to flow out, and the bran powder remaining on the surfaces of the wheat kernels are blown off forcibly. Thus, the polished wheat from which all the bran powder and the water are removed, that is, the cleaned polished wheat, falls within the discharge chute 206 and is discharged. On the other hand, the polluted water into which the bran powder is melt is blown off into the water discharge chamber 230 and, subsequently, is discharged through the water discharge chute 232.

In this way, the bran powder having entered into the longitudinal creases of the wheat kernels is effectively removed by the wheat cleaning apparatus 20. However, an abrupt absorption of water from the surfaces of the polished wheat kernels occurs during the cleaning, and a moisture content percentage rises by 4~5%, and is brought to a condition in which the moisture content becomes substantially adequate for milling. In this connection, the arrangement may be such that the stirring apparatus 30 to be described later is so formed as to again add water, and the water addition is executed stepwise by 1~2%.

Further, contrary to the above described embodiment, the arrangement may be such that the screw 240 is rotated in a direction reverse to the transporting direction with 1600 rpm, for example, and the inner cylinder 201 is rotated faster than the screw 240 in the same direction as the latter, with 1720 rpm, for example. In this case, as compared with the above-described embodiment, a tendency that the water is transported faster than the wheat kernels due to a difference of specific gravity is corrected. This is effective since the wheat kernels and the water can be sufficiently subjected to the immersion action during the period in which the wheat kernels and the water are guided and delivered towards the discharge port 209 by the screw blade 241.

The wheat kernels having passed through the wheat cleaning apparatus 20 are fed, through the transporting path W3, into the supply port 33*a* of the upwardly-feeding screw conveyor 31 serving as a part of the stirring apparatus 30. The surfaces of the polished wheat kernels, to which moisture has been added by the cleaning action, are brought to a sticky condition due to the actions of gluten and starch. However, since the polished wheat kernels are subjected to a stirring action by the screw 39 for a predetermined period of time, the polished wheat kernels are transported upwardly without the wheat kernels being adhered to each other. During the time in which the wheat kernels are transported upwardly while being stirred, penetration of moisture into the interior of the wheat cleaning apparatus 20, the heater 213 operates to clean the wheat by the warmed water, whereby cleaning and water addition can be effectively executed.

In this manner, the polished wheat kernels having reached the upper end of the upwardly-feeding screw conveyor 31 are fed from the discharge port 34 into the laterally-feeding screw conveyor 32, and are further transported while being subjected to a stirring action by the screw 37 and the stirring bars 37*a* of the laterally-feeding screw conveyor 32. The polished wheat kernels reaching a location adjacent to the transporting end terminal of the laterally-feeding screw conveyor 32 are brought to a condition in which the wheat kernels have sufficiently absorbed the moisture adhered to the surfaces thereof causing the surfaces to be dried. The polished wheat kernels flow out from the discharge port 33*b* are thrown into the tempering tank 42 while being scattered by the scattering blade 43. The stirring action by this stirring apparatus 30 is executed for approximately 20 minutes.

The polished wheat kernels within the tempering tank 42 are left for 4~6 hours under a condition as they are, so as to execute "aging" for a short period of time. The wheat kernels are brought to a condition of uniform moisture distribution as a whole, thereby improving the milling condition.

The wheat kernels after having undergone the "aging" at the tempering tank 42 flow out into the receiving chute 45 by the rotation of the rotary valves 44 and 44, and are fed to the laterally-feeding screw conveyor 52 by the discharge screw conveyor 46 and the bucket elevator 47. Subsequently, the wheat kernels are poured into the regulation tank 51 of the milling apparatus 50. A uniform penetration of moisture among the wheat kernels and a uniform loosening action develop while the polished wheat kernels passing through the lateral-feeding screw conveyor 52 are again stirred and transported. About 0.5~2.5 hours prior to the first grinding and pulverizing executed by a first milling machine 53 of the milling apparatus 50, the polished wheat kernels are again subjected to a foggy moisture addition by the moisture adding nozzle 55, if desired.

A subsequent specific action in the milling apparatus 50 is not explained here. However, the raw wheat is ground successively and stepwise by various break roll machines, to take out endosperm portions as coarse kernels, and is separated by various sifters. Further, the coarse kernel is cleaned and then purified by a purifier and, subsequently, is ground by a roll machine (smooth roll), to extract finished powder of high quality.

Figure 4:
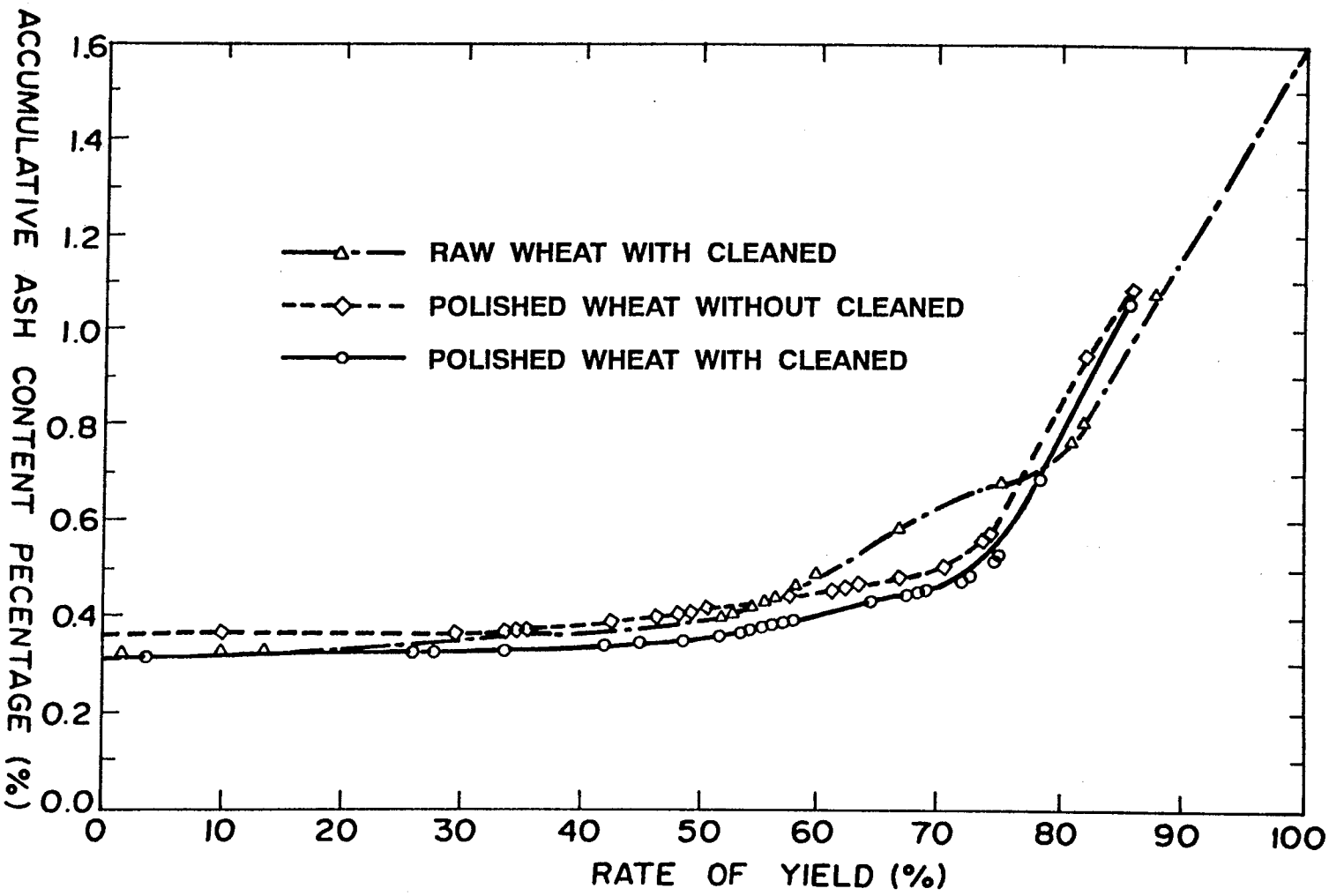
FIG. 4 is a graphical representation showing accumulative ash-content curves.

Respective accumulative ash-content curves of the wheat which is polished and cleaned, of the wheat which is milled but not cleaned, and of the raw wheat which is cleaned are indicated in FIG. 4. As seen in FIG. 4, by performing the cleaning process on the polished wheat, a yield of first-grade powder (ash content percentage: 0.4%) increases 11.53% as compared with unprocessed wheat, and special-grade powder (ash content percentage: 0.33%) could be collected or extracted 33.4%. This is considered to have resulted from the state that the bran powders in the longitudinal creases are apt to be removed, due to the cleaning process conducted on the polished wheat.

As described above, the flour milling method and the system therefor according to the invention are arranged such that, by cleaning the polished wheat kernels, the bran powder sticking into the longitudinal creases of the wheat kernels in the course of the polishing action can be effectively cleaned and washed away. Thus, a milling characteristic is improved.

As the wheat cleaning apparatus used in the flour milling system according to the invention has such an arrangement that the screw is arranged within the rotating inner cylinder, and the draining section having the perforated wall is arranged adjacent to the terminal end of the cylinder, the bran powder having absorbed water and which is apt to flow out from the longitudinal creases can forcibly be removed by centrifugal dehydration at the draining section. Thus, it is possible, with a simple arrangement, to easily remove the bran powders within the longitudinal creases. Particularly, in the case where the screw is driven in a direction opposite to the transporting direction, and the inner cylinder is rotated in the same direction and at the speed higher than the screw, there occurs an action wherein the cleaning water tending to burst out is blocked or dammed by the screw blade, whereby the wheat kernels can effectively be cleaned.

While the invention has been described in its preferred embodiment, it is to be understood that the words which have been used are words of description rather than limitation and that changes within the purview of the appended claims may be made without departing from the true scope and spirit of the invention in its broader aspects.

What is claimed is:

1. A flour milling method comprising the steps of polishing the raw wheat and milling the polished wheat, said method further comprising a step of cleaning with water the polished wheat for removing bran powder which has entered into longitudinal creases of wheat grains during said polishing step of the raw wheat, at a subsequent step of said polishing step of the raw wheat.

2. A flour milling method according to claim 1, further comprising a step of stirring the polished wheat at a subsequent step of said cleaning step of the polished wheat.

3. A flour milling method comprising the steps of separating foreign materials from raw wheat, humidifying the raw wheat to soften outer portions of the raw wheat, polishing the raw wheat, and conditioning the polished wheat, said method further comprising a step of cleaning with water the polished wheat for removing bran powder which has entered into longitudinal creases of wheat grains during said polishing step of the raw wheat, at a subsequent step of said polishing step of the raw wheat.

4. A system for flour milling comprising:

a polishing means for polishing the raw wheat to produce wheat kernels;

a cleaning means arranged downstream of said polishing means, for cleaning with water the polished wheat kernels to remove bran powder which has entered into longitudinal creases of wheat grains while the raw wheat is being polished by said polishing means; and a milling means arranged downstream of said cleaning means, for milling and pulverizing the cleaned wheat kernels.

5. A system for flour milling according to claim 4, further comprising a stirring means for stirring the wheat kernels cleaned by said cleaning means, said stirring means being arranged downstream of said cleaning means.

6. A system for flour milling according to claim 5, wherein said stirring means comprises:

an upwardly-feeding screw conveyor having an upstanding trough in which a first screw is rotatably arranged; and a laterally-feeding screw conveyor having a horizontally arranged trough in which a second screw having thereon a plurality of stirring bars is rotatably arranged, said upwardly-feeding screw conveyor and said laterally-feeding screw conveyor being connected in series.

7. A system for flour milling comprising:

a separating means for separating foreign materials from raw wheat;

a humidifying means arranged downstream of said separating means, for humidifying the raw wheat to soften outer portions of the raw wheat;

a polishing means arranged downstream of said humidifying means, for polishing the humidified raw wheat to produce wheat kernels;

a cleaning means arranged downstream of said polishing means, for cleaning with water the polished wheat kernels to remove bran powder which has entered into longitudinal creases of wheat grains while the raw wheat is being polished by said polishing means; and a conditioning means arranged downstream of said cleaning means, for conditioning the cleaned wheat kernels.

8. A system for flour milling according to claim 7, wherein said cleaning means comprises:

a machine frame having one end communicated with a kernel supply passage to which said polished wheat kernel and cleaning water are supplied, and the other end communicated with a kernel discharge passage;

an inner cylinder rotatably mounted within said machine frame, extending laterally through said kernel supply and discharge passages, and having at a portion near the kernel discharge passage a perforated draining section and at the remaining portion a kernel immersion section; and a screw arranged within said inner cylinder to be rotated in a normal or a reverse direction, whereby said inner cylinder and said screw are rotated in the same direction and at speeds different from each other so that they transport the polished wheat kernel towards said kernel discharge passage.

9. A system for flour milling according to claim 8, wherein said screw arranged within said inner cylinder is rotated faster than said inner cylinder in the case where the screw is rotated such that an advancing direction of a helical blade of the screw is the same direction as a transporting direction of the polished wheat kernel.

10. A system for flour milling according to claim 8, wherein said screw arranged within said inner cylinder is rotated slower than said inner cylinder in the case where the screw is rotated such that an advancing direction of a helical blade of the screw is opposite to a transporting direction of the polished wheat kernel.

* * * * *

UNITED STATES PATENT AND TRADEMARK OFFICE

CERTIFICATE OF CORRECTION

PATENT NO. : 5,271,570

DATED : December 21, 1993

INVENTOR(S) : Toshihiko SATAKE, Satoru SATAKE, Takeshi, ISHII, Yoshihiro TOKUI

It is certified that error appears in the above-identified patent and that said Letters Patent is hereby corrected as shown below:

Column 9, line 30, after "wheat", insert --kernels is promoted. In this connection, in the wheat--.

Signed and Sealed this

Fourth Day of October, 1994

*Attest:*

*Attesting Officer*

BRUCE LEHMAN

*Commissioner of Patents and Trademarks*